US008048242B1

(12) United States Patent
Tappan et al.

(10) Patent No.: US 8,048,242 B1
(45) Date of Patent: Nov. 1, 2011

(54) NANOCOMPOSITE THERMITE INK

(75) Inventors: Alexander S. Tappan, Albuquerque, NM (US); Joseph Cesarano, III, Albuquerque, NM (US); John N. Stuecker, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 1216 days.

(21) Appl. No.: 11/696,904

(22) Filed: Apr. 5, 2007

(51) Int. Cl.

| | |
|---|---|
| ***C06B 33/00*** | (2006.01) |
| ***C06B 27/00*** | (2006.01) |
| ***D03D 23/00*** | (2006.01) |
| ***D03D 43/00*** | (2006.01) |

(52) U.S. Cl. ..... 149/37; 149/87; 149/108.2; 149/109.2; 149/109.4

(58) Field of Classification Search ..... 149/22, 149/37, 87, 108.2, 109.2, 109.4
See application file for complete search history.

(56) References Cited

U.S. PATENT DOCUMENTS

| | | | | |
|---|---|---|---|---|
| 3,509,055 | A * | 4/1970 | Bauer | 508/306 |
| 3,552,127 | A * | 1/1971 | Morrell | 60/215 |
| 7,052,562 | B1 * | 5/2006 | Stec et al. | 149/19.92 |
| 2004/0226638 | A1 * | 11/2004 | Posson et al. | 149/45 |
| 2006/0243151 | A1 * | 11/2006 | Vine et al. | 102/202.5 |

OTHER PUBLICATIONS

Alexander S. Tappan et al "Optical Pyrometry Temperature Measurement of Miniature Charges of MIC Nanocomposite Thermite", Sandia National Laboratories Report SAND2006-2864C, 33rd International Phrotechnics Seminar, Ft. Collins, CO, USA, Jul. 16-21.
John J. Granier et al, "Laser ignition of nanocomposite thermites", Combustion and Flame, vol. 138, (2004), pp. 373-383.

* cited by examiner

*Primary Examiner* — James McDonough
(74) *Attorney, Agent, or Firm* — Carol I. Ashby

(57) ABSTRACT

A nanocomposite thermite ink for use in inkjet, screen, and gravure printing. Embodiments of this invention do not require separation of the fuel and oxidizer constituents prior to application of the ink to the printed substrate.

17 Claims, 1 Drawing Sheet

NANOCOMPOSITE THERMITE INK

The United States Government has rights in this invention pursuant to Department of Energy Contract No. DE-AC04-94AL85000 with Sandia Corporation.

BACKGROUND OF THE INVENTION

This invention relates to an energetic ink based on nanocomposite thermites.

Vine et al. (U.S. Patent Application Publication 2006/0243151) reports an explosive device is provided, containing an explosive formulation or explosive ink, which is capable of being disposed of onto a substrate for the device by well known printing and depositing techniques, such as screen printing, ink jet printing or gravure methods. The formulation contains an ink resin binder, a metal and a non-metal in particulate form where the diameter of the particles is less than 10 .mu.m, such that when the formulation is heated, a reactive output results. The substrate can be chosen from any inert material or alternatively an energetic material for which the formulation provides a means of initiation. Preferred metals are aluminum iron or titanium and non-metals are carbon, silicon, boron or metal oxides such as copper oxide, nickel oxide or molybedenum oxide. The method of producing an explosive device comprises the steps of: a) mixing a potion of a binder with at least one metal in the form of particles having a diameter of less than 10 .mu.m; b) mixing a further portion of the binder with at least one non-metal, wherein the non-metal is selected from a metal oxide, or any non-metal from Group III or Group IV in the form of particles having a diameter of less than 10 .mu.m; c) mixing together the products of a) and b) to provide an explosive formulation; d) depositing the formulation so produced onto a substrate; and e) causing the formulation to dry on said substrate. The method of depositing an explosive formulation, includes the steps of: a) loading a printing apparatus with a mixture of a binder with at least one metal in the form of particles having a diameter of less than 10 .mu.m and with a mixture of a binder with at least one non-metal, wherein the non-metal is selected from a metal oxide, or any non-metal from Group III or Group IV in the form of particles having a diameter of less than 10 .mu.m such that the at least one metal and/or at least one non-metal mixtures are held separate in the apparatus; b) drawing up selected aliquots of the at least one metal and the at least one non-metal mixtures and mixing the same in-situ immediately prior to operation of the apparatus to deposit an explosive formulation onto a substrate.

BRIEF DESCRIPTION OF THE DRAWINGS

The accompanying drawings, which are incorporated in and form part of the specification, illustrate some embodiments of the present invention and, together with the description, serve to explain the principles of the invention.

DETAILED DESCRIPTION OF THE INVENTION

Figure 1:
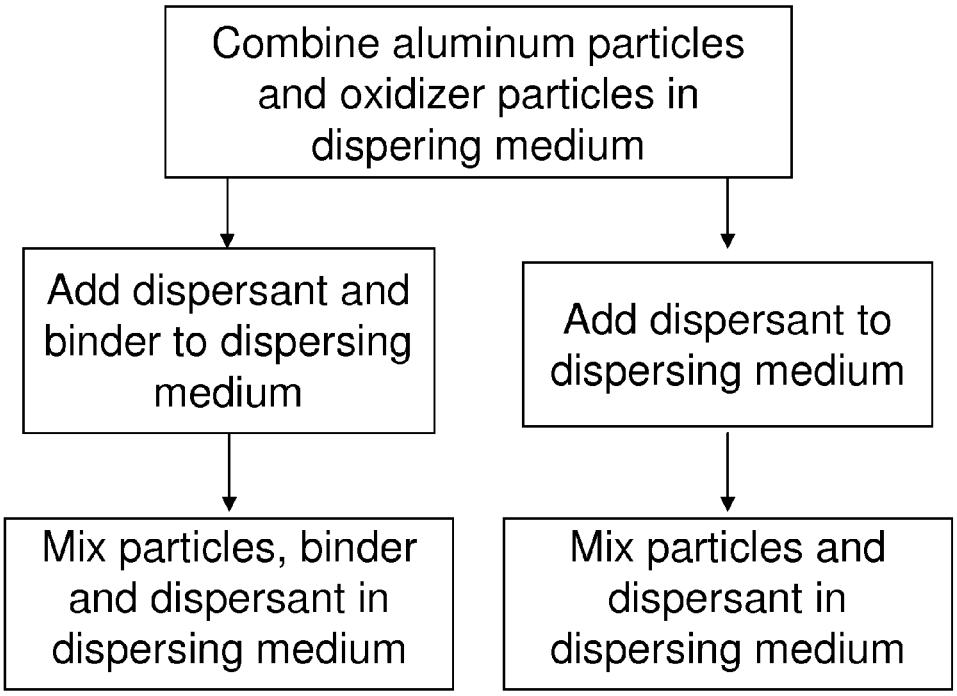
FIG. 1 illustrates the method of preparing some embodiments of the nanocomposite thermite ink.

This invention comprises thermite inks. Nanocomposite thermites (also known as metastable intermolecular composites (MIC) and superthermites) display useful initiation and combustion behavior due to the small size of the reactant powders. The high surface area of nanometer-scale particles results in particles with a sensitivity to initiation and combustion that makes them suitable for use in energetic ink formulations. Nanocomposite thermites are able to sustain combustion at sub-millimeter geometries due to their high reaction enthalpies. Nanocomposite thermites exhibit both a high burning rate and a high energy content. It is desirable to have energetic inks that do not require separation of the fuel and oxidizer constituents until immediately prior to application of the ink by an inkjet printer or other printing technique, such as screen printing or gravure printing. The requirement of constituent separation results in increased mechanical complexity and decreased convenience for the printer. The embodiments of this invention contain both the metal particles and the oxidizer particles in a single suspension that can be prepared before adding the ink to the printing equipment, thereby removing the need for in-situ mixing immediately prior to operation of the apparatus being used to print the ink.

For the purpose of this invention, we define thermite and MIC to include materials other than metal oxides as oxidizers; we include fluorocarbons in the definition of these terms.

In embodiments of this invention, aluminum particles are combined with oxidizer particles of a metal oxides, such as, in some embodiments, bismuth oxide and/or a fluorocarbon, such as, in some embodiments, poly(tetrafluoroethylene) PTFE. Micrometer and sub-micrometer particle sizes are employed to obtain the sensitivity suitable for ink applications. A suitable particle size is one which can remain suspended while in the dispersing medium of the ink and which will propagate a combustion reaction upon drying. In general, this will include particle sizes not exceeding 10 micrometers. Both the ease of suspension and the sensitivity of a particular formulation will generally be enhanced by the use of smaller particles. Sensitivity is defined as ease of ignition and propagation after initiation by the regular means, such as electrical, thermal, optical, or mechanical. In the demonstrated embodiments, commercially available nanoscale aluminum, nanoscale bismuth oxide, and/or microscale PTFE have been employed. The formula $C_2F_4$ is used in the equations below to represent a generic fluorocarbon and is not meant to restrict the invention to fluorocarbons of that exact stoichiometry. Fluorocarbons with a F-to-C ratio less than 2:1 are also intended for some embodiments of this invention. The relative contribution of the two oxidizers can be adjusted in different embodiments to partition between two product pairs: $Al_2O_3$+Bi versus $AlF_3$+C. Note that C refers to a general C-containing product and is not intended to designate only elemental carbon. The C product can vary between elemental C and an oxide of carbon such as, for example, CO and $CO_2$, depending on the amount of oxygen present in the ambient atmosphere. Similarly, the final Bi product can range from elemental Bi to an oxide of bismuth if oxidation of the Bi product occurs after the initial reaction. The idealized reactions include:

$$2Al+Bi_2O_3 \rightarrow Al_2O_3+2Bi$$

$$Al+3/4\ C_2F_4 \rightarrow AlF_3+3/2\ C$$

$$3Al+Bi_2O_3+3/4\ C_2F_4 \rightarrow Al_2O_3+AlF_3+2\ Bi+3/2\ C.$$

By varying the relative amounts of bismuth oxide and fluorocarbon, the product of aluminum oxidation can be shifted in various embodiments between aluminum oxide and aluminum fluoride.

The oxidizing capability of the fluorocarbon is enhanced when the fluorocarbon contains a higher percentage of fluorine. An example of a fluorocarbon that is convenient for use in embodiments of this invention is poly(tetrafluoroethylene), which is readily available in micrometer-scale particles.

Other fluorocarbons available in micrometer-scale or smaller particles could also be employed in embodiments of this invention.

In some embodiments, a fluorocarbon such as poly(vinylidene fluoride/hexafluoropropylene) is used as a binder and also as a source of oxidizing fluorine. The binder is selected to be soluble in the dispersing medium. Examples of poly(vinylidene fluoride/hexafluoropropylene) include the commercial products Fluorel® and Viton A®. Fluorel® FC-2175 was employed in the demonstrated embodiments, but other fluorocarbon binder materials can also be employed. Some examples include but are not restricted to THV (poly (vinylidene fluoride/hexafluoropropylene/tetrafluoroethylene)), FK-800 (Kel-F 800, copolymer of chlorotrifluoroethylene (CTFE) and vinylidene fluoride), or poly(vinylidene fluoride/tetrafluoroethylene). Fluorocarbon binders can be especially suitable in some embodiments since they can serve as additional oxidant. Binders which are not fluorocarbons or which do not contribute as oxidants may also be used but will generally decrease the energetic output of the reactions. Energetic binders, such as AMMO (azidomethylmethyloxetane polymer), BAMO (bisazidomethyloxetane polymer), GAP (glycidyl azide polymer), NMMO (2-nitratomethyl-3-methyloxetane), polyGLYN (polymer of 2-nitratomethyloxirane, also known as PGN, polyglycidyInitrate), polyNIMMO (polymer of 3-nitratomethyl-3-methyloxetane), and nitrocellulose may also be employed in embodiments of this invention. Many materials which are soluble in the dispersing medium and which are solids at room temperature may serve as binders. Some embodiments of this invention do not employ materials added specifically to serve as binders.

Additional Al for reaction with the binder fluorocarbon can be included in the formulation. The relevant chemical reaction (without suggesting the specific compound products for the C and H) is $$7\ Al + C_{16}H_{11}F_{21} \rightarrow 7\ AlF_3 + 16\ C + 11\ H.$$

Several formulations have been prepared with the proportions of the various components being selected to produce an approximately stoichiometric reaction. Numbers are in wt. % (mass percent) unless noted. The aluminum listed in the table was nano-scale, contained a native aluminum oxide shell and therefore the amount added was adjusted for the 24% native oxide coating. For different types of aluminum, the total amount used can be adjusted for any native aluminum oxide coating. For pure aluminum with no native oxide, pure bismuth oxide, and no additives, the stoichiometric composition would be 10.4% aluminum and 89.6% bismuth oxide. FC represents the binder Fluorel® FC2175 in this table. The materials in the table represent the energetic portion of the ink formulations. A dispersant (Solsperse® 32500) was also added to the ink as a further dilution in a dispersing medium of 70:30 ethyl lactate/ethyl acetate to improve the homogeneity and provide an ink that remained dispersed during the printing process. Some examples of alternative dipersing media include but are not restricted to one or more of butyl acetate, methyl lactate, acetone, methyl ethyl ketone, and tetrahydrofuran. This dispersant constituted 3 wt % when evaporated to dryness. Use of a dispersant is helpful but not necessary. When the solids were dispersed by ultrasonic agitation in the mixed esters at a concentration of 100 mg/mL, the resulting inks printed well, deposited at a useful rate, and did not clog the inkjet excessively. Other concentrations can also be used, as discussed below.

| Formulation | Al oxidized by Bismuth oxide | Al oxidized by fluorocarbon | Total Al wt. % | Bismuth oxide wt. % | PTFE wt. % | FC wt. % |
|---|---|---|---|---|---|---|
| 1 | 0% | 100% | 31.91 | 0 | 63.09 | 5.00 |
| 2 | 25% | 75% | 24.06 | 36.08 | 34.85 | 5.00 |
| 3 | 50% | 50% | 19.47 | 57.13 | 18.40 | 5.00 |
| 4 | 75% | 25% | 16.47 | 70.91 | 7.61 | 5.00 |
| 5 | 100% | 0% | 14.35 | 80.65 | 0 | 5.00 |

The ignition and combustion behavior of deposits made with these inks is described in Alexander S. Tappan, Robert J. Pahl, Anita M. Renlund, John J. Nogan, William C. Sweat, and Frederick B. McCormick, "Optical Pyrometry Temperatue Measurement of Miniature Charges of MIC Nanocomposite Thermite," 33rd International Pytrotechnics Seminar, Ft. Collins, Co, USA, Jul. 16-21, 2006."

While in general, maximum performance may be expected when the composition is close to stoichiometric, variations from stoichiometric may also be used. For example, fuel-rich formulations may propagate at slightly faster rates. Aluminum is the primary fuel in embodiments of this invention, but contributions to total fuel can be made by carbon-containing and hydrogen-containing compounds. It is to be expected that variation from ideal stoichiometry will also perform well in applications of embodiments of this invention. It is to be expected. While variation in excess of 20% from ideal stoichimetry may be expected to work, variations on the order of 20% or less from ideal stoichimetry may be expected to work well. A thin printed line need not react completely to achieve useful performance. Some unreacted material may exist after combustion. This is especially the case at the interface between the printed material and the substrate, which can act as a heat sink. This effect may be more pronounced for very thin films of the material, or where the film thickness may be thinner in a localized region.

The oxidizer content of the formulation in the preceding table was varied based on the mass percent of aluminum oxidized to $Al_2O_3$ and $AlF_3$. The contribution of the fluorocarbon binder was a constant in the demonstrated embodiments and was not considered in these particular embodiments in calculating the Al mass to employ. These embodiments varied the ratio of aluminum oxidized by bismuth oxide to that oxidized by PTFE from 0/100 to 100/0 in steps of 25%. Other embodiments can employ different ratios of constituents, and it is intended to include such differing ratios of constituent in the formulation in the scope of this invention. For maximum velocity of propagation, maximum performance at small scales, and maximum ignition sensitivity, varying the oxidizer away from PTFE and towards bismuth oxide should be performed. For maximum velocity of propagation, maximum performance at small scales, and maximum ignition sensitivity, a near-stoichiometric, or slightly fuel-rich composition should be used. In applications where the reaction velocity and/or ignition sensitivity is desired to be different, off-stoichiometric (either fuel-rich, or fuel-lean) compositions may be employed. The desired behavior is also a function of scale, with smaller devices needing a closer to stoichiometric composition for performance. A formulation that doesn't function at a given scale with a given ignition input may function acceptably at larger scales. It is expected that most formulations will be near stoichiometric, however Granier and Pantoya (J.C. Granier and M. L. Pantoya, "Laser ignition of nanocomposite thermites, Combustion and Flame, vol. 138, (2004) p. 373-383) showed that a formulation with an equivalence ratio of 1.2 showed the highest combustion velocity in a nanoscale thermite and that an equivalence ratio as high as 4.45 would propagate. Equivalence ratio ($\phi$) is defined as:

$$\phi=(\text{Fuel/Oxidizer})\text{actual}/(\text{Fuel/Oxidizer})\text{stoichiometric},$$

where mass ratios are used. It can be expected that applications may exist where these large deviations from stoichiometric compositions (either fuel-rich, or fuel-lean) may be desirable.

In some embodiments, nanoscale aluminum (50 nm, 76% active from Nanotechnologies Inc.) was used. The estimated mass of Al was adjusted for the 24% native oxide coating. In these embodiments, nanoscale bismuth oxide ($Bi_2O_3$ 40 nm, from Nanophase Technologies Corp.) and PTFE (1 micrometer, Sigma-Aldrich) were used as the principal oxidizers. Five percent by mass of a fluorocarbon binder (Fluorel® FC-2175 from Machl Inc.) was used in these embodiments.

The relatively large size (1 micrometer) of the PTFE particles used in these illustrative embodiments may make it more difficult to ignite embodiments where the formulation contains a greater percentage of fluorocarbon relative to bismuth oxide as the oxidizer. It is to be expected that ignition can be achieved at higher relative PTFE concentration if the PTFE particles are smaller or if higher-energy ignition sources are employed.

In these embodiments, the materials were mixed using ultrasonication in a fluid of mixed esters. A variety of fluid dispersing media can be used provided they produce inks with proper viscosities, surface tensions, and drying times for the ink application technique being used. Typical ink application modes include but are not limited to inkjet printing, screen printing, and gravure printing. For inkjet printing, the drying time needs to be slow enough that the ink in the inkjet nozzle does not dry and clog the nozzle if printing is suspended for a brief period of time (typically on the order of 1 minute). If more than one printing pass is to be made, the ink from the previous pass should have mostly dried. Acceptable ink viscosities are typically up to approximately 100 centipoise (cP); values on the order of 40 cP or less generally exhibit better performance. Ink surface tensions should generally be above 35 mN/m. Acceptable drying times are will depend on the application mode for the ink. For inkjet applications of the inks of this invention, solids suspension concentrations of between about 10 mg/mL and about 250 mg/mL may be used. Some embodiments emply a concentration of 100 mg/mL in 70:30 ethyl lactate/ethyl acetate as the dispersing medium.

A dispersant is employed in embodiments of this invention. The dispersant plays an important role in providing a uniform suspension of the aluminum and oxidizer particles. It improves the uniformity, stability, and performance of the ink. The dispersant is an additive that is soluble in the dispersing medium and interacts with the surfaces of the suspended particles to keep them suspended by retarding or preventing aggregation or flocculation. The dispersant should be soluble in the dispersing medium, bind to the surface of the suspended particles, and keep the particles from settling out of the suspension long enough for the ink to be printed. The dispersant helps establish the stability of the ink that allows it to be premixed rather than mixed immediately before printing within the printing apparatus. Typical dispersants are polymers, either non-ionic or ionic. It is common practice to add dispersant at level between 0 and 5% of the particle mass. Various addition orders are possible. Two methods of preparing some embodiments of this invention are shown in FIG. 1. In some embodiments, solids are first added to the mixing container, then the dispersing medium, then a solution of the dispersant and optionally a solution of a binder. In these embodiments, this order of addition was found to produce a relatively homogeneous ink. In some embodiments, the solids are first added to the mixing container, and then a solution of both the dispersant and the binder dissolved in the dispersing medium. In some embodiments, a solution of both the dispersant and the binder dissolved in the dispersing medium are first added to the mixing container and then the solids. In the five demonstrated embodiments listed in the table above, the commercially available dispersant, Solsperse 32500 (a polymeric amide) was employed as a suitable dispersant for the $Al/Bi_2O_3$/PTFE/Fluorel FC-2175 system in ethyl lactate/ethyl acetate because this dispersant is known to be effective for suspending transition metal oxides in this dispersing medium. There are numerous dispersants that could also be used, depending in part on the nature of the dispersing medium. In one embodiment, 5% of Zephrym PD2206 (a nonionic polyester) was employed using octane or decane as dispersing media for $Al/Bi_2O_3$. Some examples of alternative hydrocarbon solvents include but are not restricted to one or more alkanes containing between 6 and 12 carbon atoms. Some examples of alternative suitable dispersants include but are not restricted to polymeric amides, polymeric alkoxylates, polymeric fatty esters, oxylated amino alcohols, polymeric acrylates, acrylic graft copolymers, and polymeric pyrrolidinones. The dispersing medium employed in a particular embodiment will direct the selection of a suitable dispersant for use in a particular embodiment. When the dispersant is a polymer that is solid at room temperature, it can also serve as a binder. It may also act to improve the adhesion of the printed material to a substrate upon which the material is printed or the wetting properties of the material to the substrate upon which it is printed.

The dispersant in embodiments of this invention is preferably present in an amount from 0 to 5% with respect to dispersed solids. It is preferable that as little dispersant as possible is used, because the dispersant does not contribute to the energetic properties of the deposited material. In addition, above a certain concentration, excess dispersant does not interact with the surfaces of the dispersed particles and therefore does not serve the purpose of a dispersant. In addition, above a certain concentration, excess dispersant can provide a detrimental effect and cause destabilization of the dispersion through the depletion effect.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A thermite ink comprising:

aluminum particles;

oxidizer particles;

a dispersant; and a nonaqueous dispersing medium.

2. The thermite ink of claim 1, wherein the aluminum particles have an aluminum mean particle size less than approximately 10 micrometers in diameter and the oxidizer particles have an oxidizer mean particle size less than approximately 10 micrometers in diameter.

3. The thermite ink of claim 2, wherein the aluminum mean particle size is equal to or less than approximately 100 nanometers in diameter.

4. The thermite ink of claim 1, wherein the oxidizer mean particle size is equal to or less than approximately 1 micrometer in diameter.

5. The thermite ink of claim 1, wherein the oxidizer mean particle size is equal to or less than approximately 100 nanometers in diameter.

6. The thermite ink of claim 1, wherein the oxidizer particles comprise at least one of bismuth oxide and a fluorocarbon.

7. The thermite ink of claim 6, wherein the fluorocarbon is poly(tetrafluoroethylene).

8. The thermite ink of claim 1, wherein the nonaqueous dispersing medium comprises at least one of an alkane with a carbon number of 8 to 12, an alkane mixture comprising alkanes with carbon numbers of 6 to 12, and an ester fluid comprising at least one of ethyl acetate, butyl acetate, methyl lactate, and ethyl lactate.

9. The thermite ink of claim 1, comprising an aluminum amount of approximately 10 to approximately 32 dry weight percent, a bismuth oxide amount of 0 to approximately 90 dry weight percent, and a fluorocarbon amount of 0 to approximately 64 dry weight percent.

10. The thermite ink of claim 1, further comprising a binder.

11. The thermite ink of aim 10, wherein the binder comprises a fluorocarbon polymer.

12. The thermite ink of claim 10, wherein the binder comprises at least one of an hexafluoropropylene-vinylidene fluoride copolymer, a vinylidene fluoride-hexafluoropropylene-tetrafluoroethylene copolymer, a chlorotrifluoroethylene-vinylidene fluoride copolymer, a vinylidene fluoride-tetrafluoroethylene copolymer, an azidomethylmethyloxetane polymer, a bisazidomethyloxetane polymer, a glycidyl azide polymer, a polymer of 2-nitratomethyl-3-methyloxetane, a polymer of 2-nitratomethyloxirane, polyglycidylnitrate, polymer of 3-nitratomethyl-3-methyloxetane, and nitrocellulose in an amount between 0 and approximately 15 dry weight percent.

13. The thermite ink of claim 1, wherein the dispersant is at least one compound selected from the group consisting of a polymeric amide, a polymeric alkoxylate, a polymeric fatty ester, an oxylated amino alcohol, a polymeric acrylate, an acrylic graft copolymer, and a polymeric pyrrolidinone.

14. The thermite ink of claim 1, wherein the oxidizer particles are bismuth oxide, the dispersant is a non-ionic surfactant, and the dispersing medium is at least one of octane and decane.

15. The thermite ink of claim 14, comprising an aluminum amount between 13 and 14 dry weight percent and a bismuth oxide amount between 86 and 87 dry weight percent.

16. The thermite ink of claim 1, wherein the ink is produced by a process comprising the steps of:

combining the dispersing medium with the aluminum particles and the oxidizer particles;

adding a solution of the dispersant to the dispersing medium containing the aluminum particles and the oxidizer particles;

optionally adding a solution of a binder to the dispersing medium containing the aluminum particles and the oxidizer particles; and mixing the aluminum particles, the oxidizer particles, the dispersant, and optionally the binder in the dispersing medium to product a suspension of the aluminum particles and the oxidizer particles.

17. The thermite ink of claim 1, wherein the ink is produced by a process comprising the steps of:

combining the aluminum particles and the oxidizer particles;

adding a solution of the dispersant and optionally of a binder in the dispersing medium optionally containing the binder also in solution to the aluminum particles and the oxidizer particles;

mixing the aluminum particles, the oxidizer particles, the dispersant, and optionally the binder in the dispersing medium to product a suspension of the aluminum particles and the oxidizer particles.

* * * * *